US005353995A

United States Patent [19]

Chabert

[11] Patent Number: 5,353,995

[45] Date of Patent: Oct. 11, 1994

[54] DEVICE WITH ROTATING IONIZER HEAD FOR ELECTROSTATICALLY SPRAYING A POWDER COATING PRODUCT

[75] Inventor: Pierre Chabert, Crolles, France

[73] Assignee: Sames S.A., Meylan, France

[21] Appl. No.: 71,060

[22] Filed: Jun. 4, 1993

[30] Foreign Application Priority Data

Jun. 10, 1992 [FR] France ..... 92 06962

[51] Int. Cl.[5] ..... B05B 5/04

[52] U.S. Cl. ..... 239/701; 239/703; 239/706

[58] Field of Search ..... 239/690, 697, 698, 700, 239/701, 703, 224, 223, 524, 706

[56] References Cited

U.S. PATENT DOCUMENTS

| | | | |
|---|---|---|---|
| 2,759,763 | 8/1956 | Juvinall | 239/703 |
| 2,955,565 | 10/1960 | Schotland | 118/7 |
| 3,102,062 | 8/1963 | Graham et al. | 239/224 |
| 3,233,655 | 2/1966 | Graham | 239/224 |
| 3,578,997 | 5/1971 | Felici | 239/706 |
| 4,039,145 | 8/1977 | Felici et al. | 239/706 |
| 4,066,041 | 1/1978 | Buschor et al. | 239/708 |
| 4,114,564 | 9/1978 | Probst | 118/626 |
| 4,135,667 | 1/1979 | Benedek et al. | 239/707 |
| 4,360,155 | 11/1982 | Hubbell et al. | 239/288 |
| 4,896,384 | 1/1990 | Dijkhuizen | 239/524 |
| 4,921,172 | 5/1990 | Belmain et al. | 239/698 |

FOREIGN PATENT DOCUMENTS

| | | |
|---|---|---|
| 1274814 | 9/1961 | France . |
| 1574988 | 7/1969 | France . |
| 331823 | 4/1972 | Japan . |

*Primary Examiner*—Andres Kashnikow
*Assistant Examiner*—Christopher G. Trainor
*Attorney, Agent, or Firm*—Spensley Horn Jubas & Lubitz

[57] ABSTRACT

Rotating ionizer head for electrostatic application of an air-powder mixture, in particular for coating objects with powder paint fused by heat. The ionizer head is rotated by a turbine and comprises a deflector incorporating or constituting a charging electrode. A counter-electrode is set back axially from the ionizer head.

9 Claims, 1 Drawing Sheet

DEVICE WITH ROTATING IONIZER HEAD FOR ELECTROSTATICALLY SPRAYING A POWDER COATING PRODUCT

BACKGROUND OF THE INVENTION

Field of the invention

The invention concerns a device for electrostatically spraying a powder coating product such as a paint which is fused by heat, for example, and is more particularly concerned with an improvement to the means for electrostatically charging the powder to produce a wide area of impact on the object and excellent homogeneity of the deposit across all of the width of said impact area.

The invention additionally makes it possible to increase the efficiency of the deposit in comparison to what is obtained with conventional devices.

Description of the prior art

Electrostatic sprayer devices with rotating ionizer heads are known. For example, U.S. Pat. No. 4 114 564 describes a device of this kind in which the powder is ejected axially at the center of a generally bowl-shaped member which is rotated and maintained at a high voltage. The ionizing electrical field is established between said ionizer head and the object to be coated, which is grounded. There results a large flow of ions between the sprayer device and the object to be coated. This can cause poor quality of deposition and/or make it difficult to deposit powder onto parts with insulative surfaces. The invention makes it possible to improve the electrostatic charging of the powder whilst reducing the flow of ions impinging on the object.

SUMMARY OF THE INVENTION

The invention consists in a device for electrostatically spraying a powder coating product to coat objects, comprising an ionizer head comprising a generally bowl-shaped member and at least one rotating part, a passage for feeding an air-powder mixture discharging axially at the back of said ionizer head, and a counter-electrode set back axially relative to said ionizer head which comprises a deflector coaxial with and in front of the orifice of said passage, spaced from said bowl-shaped member and extending as far as the periphery thereof so as to define therewith an annular ejector outlet for said air-powder mixture, the edge of said deflector constituting or carrying a charging electrode.

The aforementioned rotating part may be the generally bowl-shaped member or the deflector. It is preferable for the rotating part to be that constituting the electrode, which in this instance is the deflector. However, it is simple and effective for the entire ionizer head assembly (meaning the bowl-shaped member and the deflector) to be rotatable about a longitudinal axis coincident with that of said feed passage discharging at the back of the ionizer head. In this case said deflector is fixed to said bowl-shaped member by spacer means.

The bowl-shaped member is usually made from an insulative material. The deflector may be made from a conductive material in which case it has a sharp edge at its outer periphery so that an ionized electrical field can be established between this edge and the counterelectrode. The field lines "envelope" the annular outlet from which the air-powder mixture is ejected with the result that the powder particles are more effectively charged by ions emitted by the electrode.

In an alternative embodiment the deflector may also be made from an insulative material. In this case conductive members are embedded inside the deflector and emerge as spikes at its periphery. It is sufficient to provide a sufficient number of regularly spaced spikes at the periphery of the deflector for the ionizing electrical field to be established between the various spikes maintained at a high voltage and the counter-electrode, the result being the same as with an electrode comprising all the conductive material deflector.

The invention will be better understood and other advantages of the invention will emerge more clearly from the following description given by way of example only with reference to the appended drawings.

DETAILED DESCRIPTION OF THE INVENTION

Figure 1:
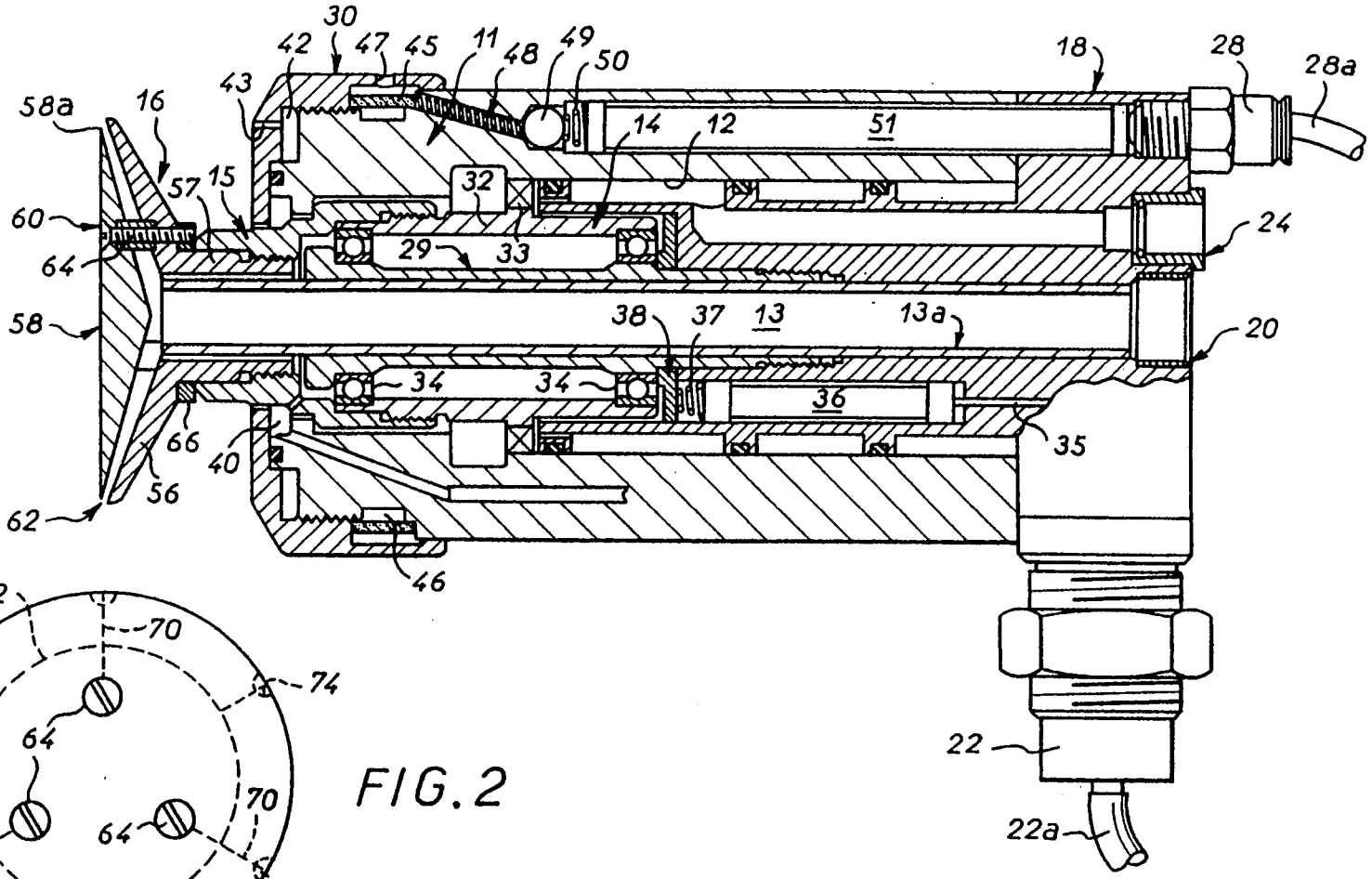
FIG. 1 is a view partly in longitudinal cross-section of a device in accordance with the invention for electrostatically spraying a powder coating product.

The electrostatic sprayer device shown in FIG. 1 essentially comprises a generally cylindrical body 11 having an axial opening 12 housing a feed passage 13 for an air-powder mixture and a pneumatically driven turbine 14 disposed around this passage. The hollow output shaft 15 of the turbine projects beyond a front surface of the body 11 and carries an ionizer head 16 which will be described in more detail later. At the opposite end the body 11 is extended by a rear member 18 also made from an insulative material and shaped to be inserted into the opening 12 over a certain axial distance as far as the rear of the turbine. This member carries a coupling 20 for the air-powder mixture, a high-voltage connector 22 adapted to be connected by an electrical cable **22*a* to a source of high-voltage, a compressed air coupling 24 for feeding the turbine and a ground connector 28 adapted to be grounded via an electrical cable 28*a*. The feed passage 13 is formed by a rigid pipe 13*a* fastened to the rear member 18 and communicating with the coupling 20. This pipe extends axially inside a sleeve 29 which supports the turbine 14. This sleeve is screwed axially into the member 18 and extends into the opening 12 in the body 11. The pipe 13*a* projects from the body 11 beyond its aforementioned front surface which is covered by a cap 30 screwed onto an external screwthread on said body. The rotor 32 of the turbine carrying the blades 33 is rotatably mounted on the sleeve 29 by means of two axially spaced ball bearings 34. The high voltage is applied to the ionizer head via a contact member 35, a resistor 36 and the component parts of the turbine 14 made from conductive material. The resistor 36 (82 MΩ) limits the current. The electrical connection between the resistor 36 and the turbine is made by a metal spring 37 compressed between one end of the resistor and an annular contact member 38 inserted between the men%her 18 and the turbine 14. Annular chambers supplied with compressed air are defined between the front surface of the body 11 and the cap 30. One annular chamber 40 is located in the immediate vicinity of the shaft 15 and air escapes via the annular clearance between the cap 30 and the shaft 15 so that the latter is cleaned continuously. Another annular chamber 42 feeds entrainment air ejector passages 43** whose orifices are coaxial with and to the rear of the ionizer head 16 towards its periphery to create a flow of air entraining the air-powder mixture towards the object to the be coated.

An annular cylindrical counter-electrode 45 is housed in an annular cavity between the body 11 and the cap 30. It is set back in the axial direction relative to the ionizer head. The counter-electrode is porous and covers a groove 46 in the body 11 fed with compressed air. The air escapes radially through equi-angularly spaced holes 47 in the cap 30. Thus the ions collected by the counter-electrode pass through the holes 47 but the air escaping from them prevents the powder accumulating on the counter-electrode. The latter is grounded by conductive members such as, in the example shown, a metal spring 48, a metal ball 49, another metal spring 50, a resistor 51 (500 MΩ), the connector 28 and the electrical cable 28*a*. Holes are provided in the body 11 for feeding the chambers 40 and 42 and the groove 46.

The ionizer head comprises a generally bowl-shaped member 56 which is made from an insulative material in this example and a deflector 58 which is made of metal in this example. The member 56 has a tubular bush, or hub, 57 screwed into the turbine shaft 15. The pipe 13*a* is inserted into the axial opening of the hub 57 without touching it and discharges at the back of the bowl-shaped member 56. The deflector 58 is coaxial with and in front of the orifice of the passage 13, being spaced from the member 56 by spacer means 60. The deflector extends radially as far as the periphery of the bowl-shaped member 56 and defines with the latter an annular ejection outlet 62 for the air-powder mixture. The edge of the deflector 58 constitutes a charging electrode.

In the FIG. 1 example the edge of the deflector 58 has a sharp edge 58*a* at its outside periphery. Also, the deflector being fastened to the bowl-shaped member 56, it is the entire ionizer head assembly which is rotated by the turbine. The spacer means 60 and in particular the metal screws 64 provide the connection from the deflector 58 to the high voltage supply. To be more precise, the screws 64 pass through the bowl-shaped member 56 and are screwed into a metal ring 66 in electrical contact with the end of the shaft 15 of the turbine.

Figure 2:
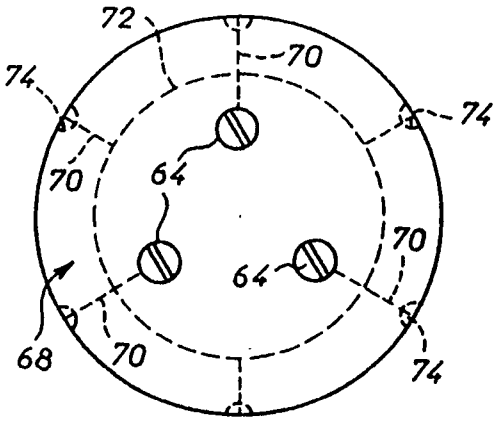
FIG. 2 is a partial view showing an alternative embodiment of the deflector of the ionizer head from the FIG. 1 device.

In the FIG. 2 embodiment the deflector 68 is made from an insulative material in which are embedded at molding time conductive members 70, 72 electrically connected to the screws 64 of the spacer means. The radially disposed conductive members 70 emerge as spikes at the periphery of the deflector. Each spike advantageously emerges within a small crater 74 in the peripheral edge of the deflector. This deflector 68 may be substituted for the deflector 58 in FIG. 1.

In operation the air-powder mixture in the axial passage 13 strikes the rotating deflector and enters the space between the bowl-shaped member 56 and the inside wall of the deflector, travelling as far as the annular outlet 62. At this outlet the powder particles are charged by bombardment of ions emitted by the deflector forming an electrode.

The ions emitted by the charging electrode can follow either of two paths. Some ions travel towards the counter-electrode and the remainder towards the object to be coated. The presence of the counter-electrode ensures that the powder is well charged whilst limiting the flow of ions towards the object.

It is estimated, for example, that the flow of ions established between the electrode and the counterelectrode is equal to approximately four times the charge carried by the powder and four times the flow of ions established between the deflector and the object to be coated. It is considered that the rotation of the ionizer head provides better homogenization of the air-powder mixture at the outlet 62 and so promotes better charging of the powder particles.

There is claimed:

1. Device for electrostatically spraying a powder coating product to coat objects comprising: an ionizer head having a back and composed of a first part constituted by a generally bowl-shaped member having a periphery and a second part constituted by a deflector, said deflector having an edge at which is defined a charging electrode, and said deflector being spaced from said bowl-shaped member and extending as far as said periphery of said bowl-shaped member to define with said bowl-shaped member an annular ejector outlet for an air-powder mixture, wherein at least one of said parts of said ionizer head is rotatable about an axis; a passage for feeding the air-powder mixture, said passage having an outlet orifice for discharging the air-powder mixture along the axis of rotation at the back of said ionizer head and into said annular ejector outlet, said orifice being located such that said deflector is coaxial with, and in front of, said orifice; and a counter-electrode set back from said ionizer head along said axis of rotation.

2. Device according to claim 1, wherein said deflector is made from a conductive material, said edge of said deflector is a sharp edge, and said deflector is fixed by spacer means to said bowl-shaped member which is fixed to rotational drive means.

3. Device according to claim 2 wherein said bowl-shaped member is made from an insulative material and said spacer means comprise metal parts adapted to connect said deflector to a high voltage supply.

4. Device according to claim 1 wherein said deflector is made from an insulative material in which are embedded conductive members forming said charging electrode adapted to be connected to a high voltage supply and which emerge as spikes at the periphery of said deflector.

5. Device according to claim 1 wherein said counter-electrode is annular and installed in an annular cavity communicating with a region external to said device through a series of regularly spaced holes.

6. Device according to claim 1 wherein said counter-electrode is porous and is disposed over an air blower groove adapted to be connected to a compressed air supply.

7. Device according to claim 1 further comprising passages for ejecting air for entraining the air-powder mixture having orifices coaxial with and to the rear of said ionizer head in order to entrain the air-powder mixture towards one of the objects to be coated.

8. Device according to claim 1 further comprising a shaft carrying said ionizer head, and wherein an annular chamber is defined around said shaft carrying said ionizer head and said annular chamber is adapted to communicate with a compressed air supply.

9. Device according to claim 2 wherein the rotational drive means is a turbine.

* * * * *